United States Patent [19]

Peacock

[11] 4,053,134

[45] Oct. 11, 1977

[54] PIPE MOLD HAVING INSERT SUPPORT MEANS

[76] Inventor: Bobbie D. Peacock, 702 Hippocket Road, Peachtree City, Ga. 30269

[21] Appl. No.: 695,914

[22] Filed: June 14, 1976

Related U.S. Application Data

[63] Continuation of Ser. No. 530,983, Dec. 9, 1974, abandoned.

[51] Int. Cl.[2] ..... B28B 23/00

[52] U.S. Cl. ..... 249/94; 249/97; 264/278

[58] Field of Search ..... 249/91, 93–94, 249/96, 97; 425/110, 117, 125; 264/275, 278; 164/112, 288, 332–334; 52/125, 701, 706–707, 709, 711

[56] References Cited

U.S. PATENT DOCUMENTS

| | | | |
|---|---|---|---|
| 1,145,385 | 7/1915 | Marble | 52/701 |
| 1,351,112 | 8/1920 | Martin | 52/711 |
| 1,510,978 | 10/1924 | Conklin | 52/711 |
| 2,366,401 | 1/1945 | Haskell | 249/177 |
| 3,712,014 | 1/1973 | Waerner | 52/707 |

FOREIGN PATENT DOCUMENTS

| | | | |
|---|---|---|---|
| 296,500 | 9/1928 | United Kingdom | 425/262 |

*Primary Examiner*—Ronald J. Shore
*Assistant Examiner*—John McQuade
*Attorney, Agent, or Firm*—Patrick F. Henry

[57] ABSTRACT

Concrete pipe is molded between concentric steel cylindrical shells in which there are openings on each side receiving plastic inserts defining respective keyed cavities that remain in the molded concrete pipe after curing and removal of the concentric steel shells so that large keyed eye-bolts may be inserted in the respective keyed inserts. The initial positioning of the plastic mold keyed insert is accomplished by means of a keyed plastic plunger mounted on an attaching plate which includes notches on each side to fit over attaching screws on each side of the outside steel shell. The plunger has a keyed end. The hollow plastic insert with a soft gasket around the top has a keyed plunger inserted under pressure therein for removal therefrom and replacement by the eye-bolt after the curing of the pipe is completed.

13 Claims, 9 Drawing Figures

PIPE MOLD HAVING INSERT SUPPORT MEANS

This is a continuation of application Ser. No. 530,983 filed Dec. 9,1974, now abandoned.

BACKGROUND OF THE INVENTION

1. Field of the Invention

Pipe molding procedures and methods and particularly concrete pipe molds. Pipe lifting fittings and attachments for lifting pipes.

2. Description of the Prior Art

The prior art includes plastic inserts and cavity making devices which are put into uncured pipe after the pipe is removed from the mold. Attempts to place inserts or to form lifting cavities in wet concrete while still in the mold have not been very successful because of the difficulty of positioning the open inserts or other forming devices and causing same to stay in place until the concrete is sufficiently cured. The present method and apparatus provides a means for positioning the plastic inserts, which are merely cavity making mold devices to make a proper cavity in the concrete, from the outside of the mold through the use of a temporary removable positioning device.

SUMMARY OF THE INVENTION

The method disclosed herein is directed to providing proper recessed and off-set or keyed cavities on the sides of concrete pipe during some stage of the molding thereof so that there will be a proper opening in which a lifting eye-bolt can be placed to move the heavy concrete pipe after molding without damaging same.

Therefore an object of this invention is to provide a lifting insert cavity on opposite sides of a molded concrete pipe.

Still another object of this invention is to provide a means for positioning a plastic or similar material cavity forming insert which includes the proper off-set interior so that the proper lifting insert cavity is provided in the sides of the pipe.

Another object of this invention is to provide a removable insertion apparatus which fits into a plastic insert and holds same on the outside of the pipe until after the pipe is cured at which time the insert is left in the pipe and the retaining device is removed.

An additional object of this invention resides in the particular configuration of a plastic plunger device which includes a plunger operating in a retainer plate against a coil spring with means on the end of the plunger to hold and retain a plastic insert thereon between the shells of the mold until the concrete pipe is cured.

Other and further objects and advantages of this invention will become apparent upon reading the following specification taken in conjunction with the accompanying drawings.

DESCRIPTION OF THE PREFERRED EMBODIMENT

Figures 1, 2, 3, 4, 5, 6, 7, 8, 9:
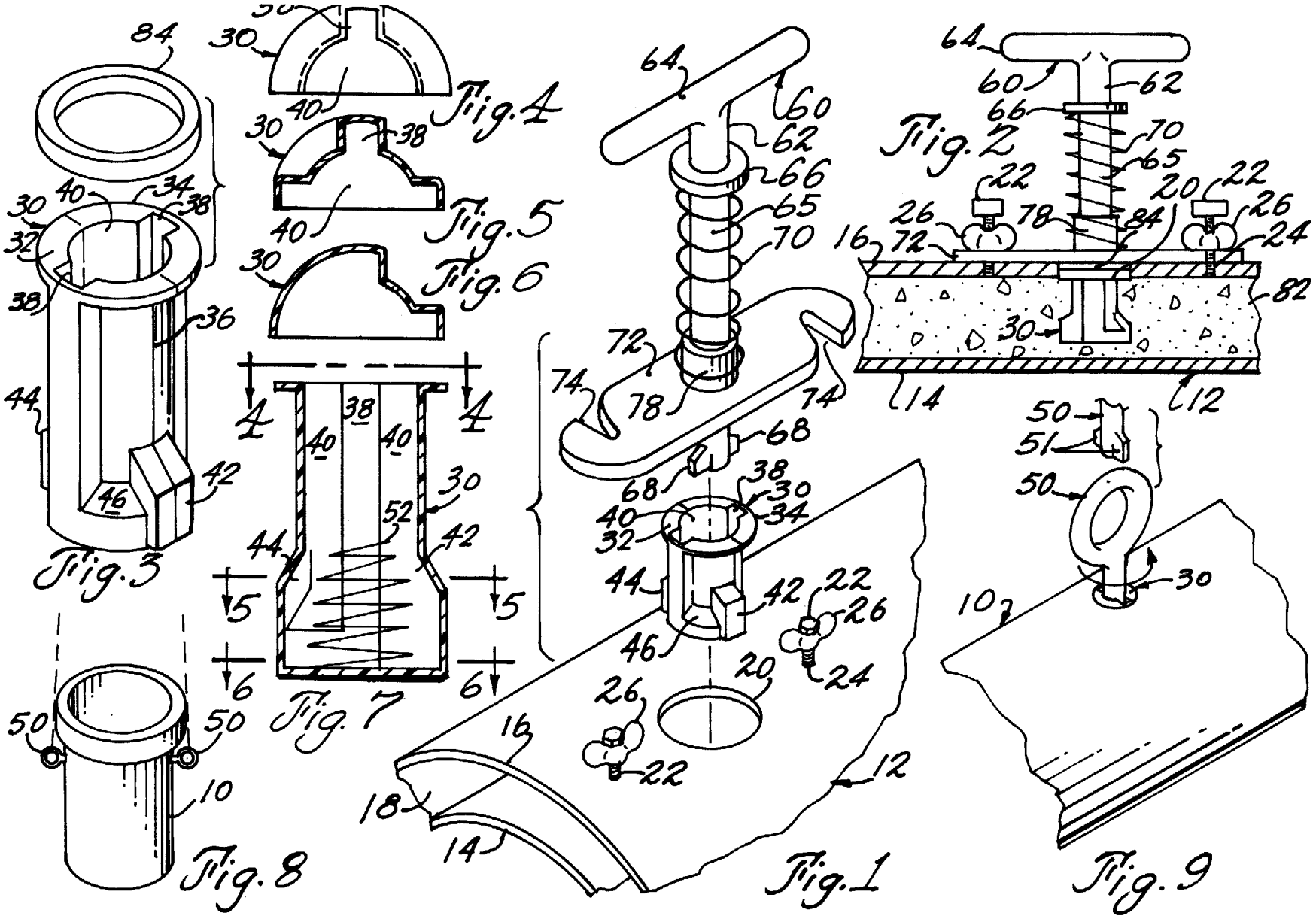
FIG. 1 is a perspective assembly view of a portion of a concrete mold, one of the plastic inserts and the retaining device.
FIG. 2 is a vertical cross-sectional view taken through the mold with the concrete pipe insert in place.
FIG. 3 is a perspective view of a plastic insert.
FIG. 4 is a top plan view taken along lines 4—4 in FIG. 7.
FIG. 5 is a cross-sectional view taken along lines 5—5 in FIG. 7.
FIG. 6 is a cross-sectional view taken along lines 6—6 in FIG. 7.
FIG. 7 is a cross-sectional view taken vertically thru the insert in FIG. 3.
FIG. 8 is a perspective view of a concrete pipe with the eye-bolts in place.
FIG. 9 is a partial perspective view of the concrete pipe illustrating the removal of the temporary plunger and the insertion of the eye-bolt.

A typical concrete pipe designated by reference numeral 10 is molded from wet, poured concrete in a shell mold shown partially in FIG. 1, designated by reference numeral 12 therein, and comprising a pair of concentric cylindrical shells 14, 16 made of suitable steel material defining a pipe cavity 18 therebetween in which the concrete pipe 10 is formed and molded by pouring concrete therein. The outer shell 16 has a circular opening 20 therethrough and on opposite sides of which are a pair of respective mounting screws or studs 22 screwed into tapped openings 24 in the shell 16 in the respective locations to remain fixed therein and on which screws 22 there are butterfly nuts 26 adjustable in one direction or the other.

Referring next to FIGS. 3 thru 7, inclusive, a thin plastic insert designated generally by reference numeral 30 is molded in an injection molding process to form two matching cavity parts 32, 34 glued or otherwise joined along a common line 36 to form a pair of opposed slotted entrances 38 providing channels on opposite sides of a cylindrical bore 40 leading to bottom recesses 42, 44 defined inside of housings and which are approximately 90° about the longitudinal axis in axial rotation from the channels 38. Molded into the bottom of the insert 30 and intersecting respective channels 38 and recesses 42, 44 there are a pair of respective tunnels on the inside each leading to a respective recess 42, 44. The tunnels 46 lead from the respective channels 38 respectively to the recess 42, 44 whereby a keyed member, like the eye-bolt 50, in FIG. 9 having key projection members 51, may be inserted down into the channels 38 against a coil spring 52 in the bottom of the insert 30 to compress the coil spring and to be rotated 90° approximately to slide along the inside of member 46 to rest in the slots 42, 44 against the pressure of the spring 52 thereby being firmly seated in place.

In FIG. 8 the concrete pipe 10 is shown with a pair of eye-bolts 50 mounted in respective openings created by inserts 30 on opposite sides of pipe 10.

INSERT POSITIONING MEANS AND METHOD

Referring again to FIG. 1, a positioning device designated generally by reference numeral 60 comprises a plunger 62 having a handle 64 thereon and a shaft 65 with a projecting storing 66 attached thereto and a lower end which includes a pair of tapered projection members 68 on opposite sides of the shaft 65 which creates a keyed end that matches with and fits into the slotted area defined by the channels 38 and the cylindrical bore 40. A heavy coil spring 70 is interposed between the stop ring 66 and a plastic mounting plate 72 having notches 74 therein to be fitted on the mounting screw 22 beneath the butterfly nuts 26. A cylindrical collar 78 is molded integrally with the mounting plate 72 to provide a barrel in which the plunger 62 slides against the coil spring 70 for the purpose of mounting the plastic insert 30 temporarily on the end of the plunger 62 by inserting the projections 68 down into the slots 38 and rotating the plunger 62 at the bottom to bring the projecting members 68 into the opposite channels 42, 44 in the manner shown in FIG. 2. After the insert 30 is mounted on the device 60 it is then inserted through the opening 20 in the manner previously described so that the butterfly nuts 26 may be tightened against the retaining plate 72 holding the insert down in between the outside shell 16 and the inside shell 14 until the concrete designated by reference numeral 82 is poured and cured sufficiently to remove the mold shells 14, 16. Plastic inserts 30 are of thin construction and serve primarily as molds to create a corresponding shape inside the concrete 82 and provide a smooth surface in the shaped openings created.

To prevent leakage of water and entry of unwanted material into the interior of the insert 30 there is a compressible gasket 84 made of polyurethane, styrofoam, vinyl, rubber or any other similar gasket material in which is positioned on the top edge of the insert 30 before the insertion of the end of the plunger 62 so that when the plunger 62 is inserted and tightened in place the gasket 84 is compressed in the manner shown in FIG. 2 tightly sealing the opening.

While I have shown and described a particular embodiment of this invention this is for purpose of illustration since there are various alterations, deviations, changes, eliminations, and departures which may be made in the embodiment shown without departing from the scope of the invention as defined in the appended claims.

I claim:

1. In an apparatus for providing lifting insert cavities in molded concrete pipe made from concrete which is poured into a pipe mold comprising rigid, inner and outer spaced shells and prior to the curing of the concrete poured therein: an inner shell and an outer shell fixed in spaced relation to each other to provide a mold in which poured concrete is placed in the space between said inner and outer shells to cure and form a rigid concrete pipe, said outer shell having at least one thru opening therein leading into the space between said inner and outer shells and receiving a cavity forming insert therethrough the cavity forming insert construction from plastic or a similar material comprising an insert body of a size smaller than the opening in the outer shell whereby said cavity forming insert is inserted thru said opening from outside after said inner and outer shells are assembled to support said insert on said outer shell and in alignment with the opening therein, said cavity forming insert having an opening in the top thereof which when in position is exposed thru the opening in said outer shell and said insert opening leading into the interior and to a closed bottom in said insert, a retaining means detachably attached to said outer shell, means on said outer shell removably attaching said retaining means to said outer shell, means on said retaining means for positioning same in said insert body prior to insertion in said opening in said outer shell for a temporary but firm engagement therewith to attach same thereto for subsequent removal therefrom after the concrete pipe is cured, and to hold same in position between said inner and outer shells whereby said insert remains inside said concrete to receive a lifting insert therein.

2. The apparatus in claim 1 further including pressure means operable between said retaining means and said cavity forming insert for mounting said cavity forming insert under pressure.

3. The apparatus of claim 2 further including compressible gasket means about the opening to the cavity forming insert and being compressed by said pressure means.

4. The apparatus in claim 1 wherein said retaining means comprises a retaining member inserted into said insert and there being spring means operatively associated with said retaining member for resisting the movement of said retaining member whereby said retaining member is inserted against the spring pressure thereby providing spring pressure to hold said member retaining in place.

5. The apparatus claimed in claim 1 wherein said attaching means includes a mounting plate comprising a pair of open slots on opposite ends thereof, a pair of respective bolts mounted in said outer shell and respective nuts on said bolts in engagement with said mounting plate after said bolts are inserted in said notches thereon.

6. The apparatus claimed in claim 4 wherein said retaining member is an elongated shaft mounted for substantially straight line movement on an attaching plate, said plate being attached to said pipe mold outer shell about said pipe opening.

7. The apparatus claimed in claim 1 wherein the top of said cavity forming insert has a flat surface therearound, and a gasket mounted on said flat surface compressed into position by said retaining means.

8. The apparatus claimed in claim 1 wherein said cavity forming insert comprises at least one channel leading to a respective tunnel at the bottom of said cavity forming insert and each respective tunnel leading to a respective recess, said retaining means comprising a retaining member having at least one projection thereon fitting into a respective recess.

9. The apparatus claimed in claim 4 wherein said retaining member comprises a flanged portion attached thereon near the top thereof and a handle extending from the top of said retaining member.

10. In an insert positioning means for providing a specially shaped cavity on the side of a concrete pipe by placing said insert into position between the inner and outer shells of a pipe mold prior to the curing of concrete poured therein: a concrete pipe mold comprising rigid, concentrically arranged inner and outer shells and said outer shell having a respective cavity forming insert opening formed therein leading to the interior thereof, a cavity forming insert constructed from thin plastic or a similar material having an open top leading to a closed bottom, said insert having at least one channel leading to the bottom thereof and a respective tunnel at the bottom of each channel leading to an off-set recess therein, a retaining means comprising a retaining member including an elongated shaft, a mounting means on said retaining means temporarily attaching said retaining means to said outer shell about said insert opening, said retaining member having at least one projecting portion on the end thereof corresponding with a respective off-set recess formed in the bottom of said insert, spring means on said retaining member, said retaining member being pushed into said insert prior to the positioning of said insert in said pipe mold to cause said projecting portion to be located within said respective off-set recess after travelling down said channel and through said tunnel against the spring pressure on said retaining member thereby tightly positioning said insert on said retaining member and said retaining member in place on said outer shell whereupon after the pouring and curing of the concrete a cavity of special formation is left in said concrete pipe and defined by said cavity forming insert so that a lifting instrumentally, such as an eye-bolt may be inserted down into said cavity so formed by said insert and rotated into position in said respective off-set recesses whereby said pipe may be lifted from said eye-bolt thereby reducing the possibility of breakage.

11. The apparatus of claim 10 further including a compressible gasket on said insert which is compressed by said retaining member upon insertion into said insert to prevent wet concrete from entering said insert.

12. The apparatus in claim 11 wherein said mounting means comprises a mounting plate having notches on opposite ends thereof and a pair of screws on said outer pipe onto which said plate fits.

13. The apparatus in claim 12 wherein said spring means on said retaining member comprises a coil spring which is confined between said mounting plate and a part of said retaining member.

* * * * *